US008502633B2

(12) United States Patent
Park et al.

(10) Patent No.: US 8,502,633 B2
(45) Date of Patent: Aug. 6, 2013

(54) PLANAR TRANSFORMER AND METHOD OF MANUFACTURING THE SAME

(75) Inventors: Geun Young Park, Gyunggi-do (KR); Sang Joon Seo, Gyunggi-do (KR); Jin An Jung, Gyunggi-do (KR); Kwang Seung Cho, Gyunggi-do (KR); Deuk Hoon Kim, Incheon (KR)

(73) Assignee: Samsung Electro-Mechanics Co., Ltd., Gyunggi-do (KR)

( * ) Notice: Subject to any disclaimer, the term of this patent is extended or adjusted under 35 U.S.C. 154(b) by 21 days.

(21) Appl. No.: 13/079,253

(22) Filed: Apr. 4, 2011

(65) Prior Publication Data

US 2011/0241816 A1 Oct. 6, 2011

(30) Foreign Application Priority Data

Apr. 5, 2010 (KR) ..... 10-2010-0031027

(51) Int. Cl.
*H01F 5/00* (2006.01)
*H01F 27/28* (2006.01)
*H01L 27/08* (2006.01)

(52) U.S. Cl.
USPC ..... 336/200; 336/223; 336/232; 257/531

(58) Field of Classification Search
USPC ..... 336/200, 223, 232; 257/531
See application file for complete search history.

(56) References Cited

U.S. PATENT DOCUMENTS 5,781,093 A * 7/1998 Grandmont et al. ..... 336/232
6,160,303 A * 12/2000 Fattaruso ..... 257/531
6,529,389 B2 * 3/2003 Perlick et al. ..... 363/20
6,584,045 B1 * 6/2003 Ishii et al. ..... 369/13.23
6,730,983 B2 * 5/2004 Minami ..... 257/531
6,914,508 B2 * 7/2005 Ferencz et al. ..... 336/200
7,084,730 B2 * 8/2006 Kitagawa ..... 336/200
7,663,225 B2 * 2/2010 Kudo et al. ..... 257/700
7,767,516 B2 * 8/2010 Aoki et al. ..... 438/238
7,838,993 B2 * 11/2010 Aoki et al. ..... 257/773
8,084,859 B2 * 12/2011 Tetani et al. ..... 257/737
8,227,851 B2 * 7/2012 Aoki et al. ..... 257/314
2006/0163692 A1 * 7/2006 Detecheverry et al. ..... 257/531
2009/0040001 A1 * 2/2009 Young et al. ..... 336/223

FOREIGN PATENT DOCUMENTS

JP 2004152622 A 5/2004
KR 1019990049949 A 7/1999

* cited by examiner

*Primary Examiner* — Mohamad Musleh
*Assistant Examiner* — Joselito Baisa
(74) *Attorney, Agent, or Firm* — Lowe Hauptman Ham & Berner, LLP

(57) ABSTRACT

There are is a planar transformer and a method of manufacturing the same that can prevent resin being coated from being separated from a conductor during the manufacturing of a transformer by forming a dummy pattern on a board. A planar transformer according to an aspect of the invention may include: a core part having a pair of cores electromagnetically coupled to each other; a board part having a plurality of boards disposed between the pair of cores and stacked upon one another; a pattern part having a power transmission pattern provided on at least one board of the plurality of boards of the board part and transmitting power being input, and a dummy pattern provided on the same board having the power transmission pattern thereon and separated from the power transmission pattern by a predetermined interval; and a resin part being coated over the at least one board of the plurality of boards, the at least one board having the pattern part thereon.

19 Claims, 4 Drawing Sheets

PLANAR TRANSFORMER AND METHOD OF MANUFACTURING THE SAME

CROSS-REFERENCE TO RELATED APPLICATIONS

This application claims the priority of Korean Patent Application No. 10-2010-0031027 filed on Apr. 5, 2010, in the Korean Intellectual Property Office, the disclosure of which is incorporated herein by reference.

BACKGROUND OF THE INVENTION

1. Field of the Invention

The present invention relates to a planar transformer and a method of manufacturing the same, and more particularly, to a planar transformer and a method of manufacturing one same that can prevent resin, being coated, from being separated from a conductor during the manufacturing of a transformer by forming a dummy pattern on a board.

2. Description of the Related Art

With the trend toward the size reduction of various kinds of electronic apparatuses, there is also a need for the size reduction of power supply units.

Basically, the size reduction of power supplies can be achieved by driving power terminals with a high frequency. However, size reduction may be inhibited by magnetic devices and capacitors.

The recent development of capacitors having small heights or small diameters, which are appropriate for slim power supply units, has accelerated a further size reduction of a wide array of electronic apparatuses.

Generally, in the case of transformers, which are representative magnetic devices, a size reduction can be achieved by forming the windings of magnetic devices by stacking multilayered boards having circuits printed thereon.

Planar transformers have patterns, formed on respective boards, which can form current paths instead of using the coils of a general transformer. The above-described boards are stacked upon one another to thereby form a single planar transformer. Insulating resin is injected between the respective boards and then flows between the patterns to thereby increase insulating properties.

However, while the boards are being stacked upon one another, the resins being injected may detach between patterns, where insulation is required, which may lead to a deterioration in insulating performance.

SUMMARY OF THE INVENTION

An aspect of the present invention provides a planar transformer and a method of manufacturing the same that can prevent resin being coated during the manufacturing of a transformer from being separated from a conductor by forming a dummy pattern on a board.

According to an aspect of the present invention, there is provided a planar transformer including: a core part having a pair of cores electromagnetically coupled to each other; a board part having a plurality of boards disposed between the pair of cores and stacked upon one another; a pattern part having a power transmission pattern provided on at least one board of the plurality of boards of the board part and transmitting power being input, and a dummy pattern provided on the same board having the power transmission pattern thereon and separated from the power transmission pattern by a predetermined interval; and a resin part being coated over the at least one board of the plurality of boards, the at least one board having the pattern part thereon.

At least one via hole, electrically connected to the power transmission pattern, may be provided in the at least one board.

The dummy pattern may be separated from the power transmission pattern and be adjacent to the at least one via hole.

The dummy pattern may be provided on a remaining region of the at least one board, on which the power transmission pattern and the at least one via hole are not provided.

Each of the plurality of boards may nave a through hole into which the core part is inserted.

The power transmission pattern may be provided along a circumference of the hoard on the basis of the through hole of the at least one board.

The power transmission pattern may be formed in a spiral shape along a circumference of the board on the basis of the through hole.

The board part may include a first board and a second board, the power transmission pattern may include a primary power transmission pattern, provided on the first board, and a secondary power transmission pattern, provided on the second board, and the primary power transmission pattern and the secondary power transmission pattern may form a predetermined turns ratio therebetween.

The board part may include a first cover board stacked upon the first board; and a second cover board stacked under the second board.

According to another aspect of the present invention, there is provided a method of manufacturing a planar transformer, the method including: preparing a plurality of boards; forming a power transmission pattern transmitting power being applied to at least one board of the plurality of boards and a dummy pattern separated from the power transmission pattern by a predetermined interval; coating the at least one board with insulating resin; and stacking the plurality of boards one upon another.

The forming of the power transmission pattern may include forming at least one via hole in the at least one board, the at least one via hole electrically connected to the power transmission pattern.

In the forming of the dummy pattern, the dummy pattern may be separated from the power transmission pattern and is adjacent to the at least one via hole.

In the forming of the dummy pattern, the dummy pattern may be formed on a remaining region of the at least one board, on which the power transmission pattern and the at least one via hole are not formed.

The preparing of the plurality of boards may include forming a through hole in each of the plurality of boards, the through hole into which the core part is inserted.

The forming of the power transmission pattern may include forming the power transmission pattern along a circumference of the board on the basis of the through hole of the at least one board.

The forming of the power transmission pattern may include forming the power transmission pattern in a spiral shape along a circumference of the board on the basis of the through hole.

The preparing of the boards may include preparing first and second boards being stacked upon one another, the forming of the power transmission pattern may include forming a primary power transmission pattern formed on the first board and a secondary power transmission pattern formed on the second board, and the primary power transmission pattern and the secondary power transmission pattern form a predetermined turns ratio.

The preparing of the boards further may include forming: a first cover board stacked upon the first board; and a second cover board staked under the second board.

BRIEF DESCRIPTION OF THE DRAWINGS

The above and other aspects, features said other advantages of the present invention will be more clearly understood from the following detailed description taken in conjunction with the accompanying drawings, in which.

DETAILED DESCRIPTION OF THE PREFERRED EMBODIMENT

Exemplary embodiments of the present invention will now be described in detail with reference to the accompanying drawings.

Figure 1:
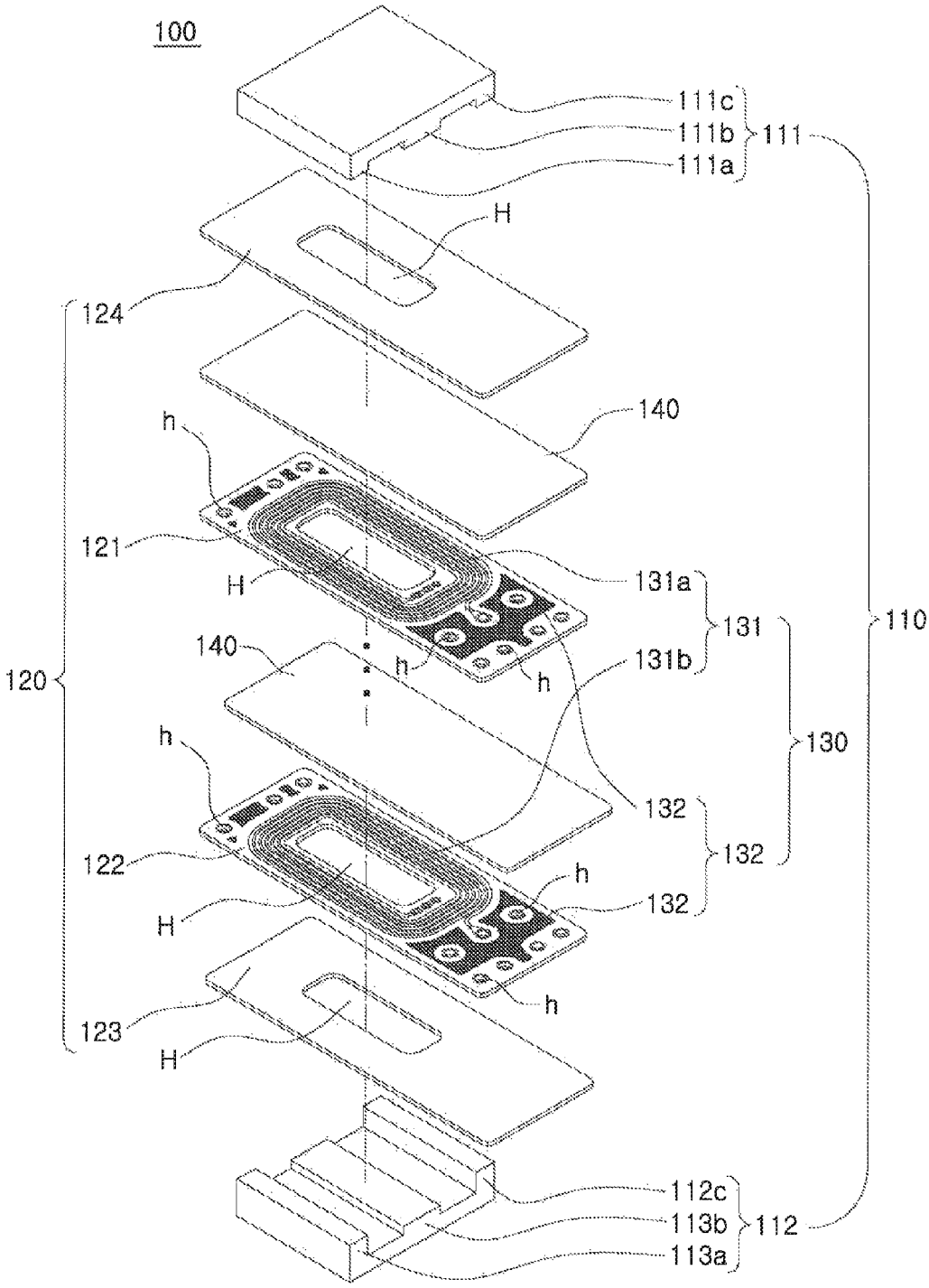
FIG. 1 is a schematic exploded perspective view illustrating a transformer according to an exemplary embodiment of the present invention.
Figure 2:
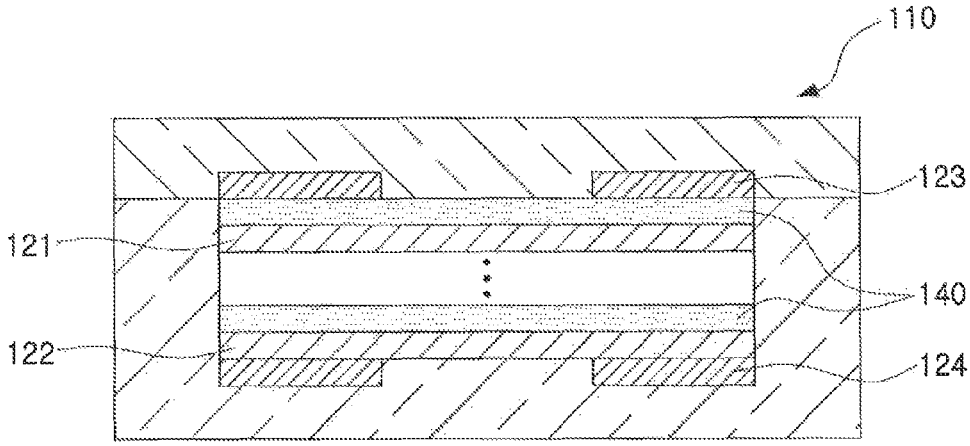
FIG. 2 is a schematic side view illustrating a transformer according to an exemplary embodiment of the present invention.

FIG. 1 is a schematic exploded perspective view illustrating a transformer according to an exemplary embodiment of the invention. FIG. 2 is a schematic side view illustrating a transformer according to an exemplary embodiment of the invention.

Referring to FIG. 1, a planar transformer 100 according to this embodiment may include a core part 110, a board part 120, and a pattern part 130.

The core part 110 may include a pair of cores 111 and 112 that are electromagnetically coupled to each other.

The pair of cores 111 and 112 may include respective legs that are electromagnetically coupled to each other.

As described in FIG. 1, the pair of cores 111 and 112 may be EE cores. However, the present invention is not limited thereto, and the pair of cores 111 and 112 may be EI cores, UU cores, UI cores, and the like.

As described in FIG. 1, while the core 111 may include first, second, and third legs 111*a*, 111*b*, and 111*c*, the core 112 may include 112*a*, 112*b*, and 112*c*, so that the pair of cores 111 and 112 may be electromagnetically coupled to each other by coupling between the first legs 111*a* and 112*a*, the second legs 111*b* and 112*b* and the third legs life and 112*c*.

The board part 120 may be provided between the pair of cores 111 and 112.

The board part 120 may include a plurality of boards.

As described in FIG. 1, the board part 120 may include at least one board or a plurality of boards. The plurality of boards may be stacked upon one another and have through holes H therein, into which the legs of the pair of cores 111 and 112 are inserted.

The plurality of boards may be configured as printed circuit boards (PCBs) that have circuits printed on the surfaces thereof.

The pattern part 130 may be individually formed on the plurality of boards.

The pattern part 130 may be composed of a conductor through which currents flow. The pattern part 130 may include a power transmission pattern 131 transmitting power being input and a dummy pattern 132 with no electrical connection.

The power transmission pattern 131 may serve as coils forming a turns ratio between primary and secondary windings of a general transformer.

For example, when the board part 120 has a first board 121 and a second board 122, a primary power transmission pattern 131*a* is formed on the first board 121, and a secondary power transmission pattern 131*b* is formed on the second board 122, so that the primary power transmission pattern 131*a* and the secondary power transmission pattern 131*b* serve as a primary winding and a secondary winding of a general transformer, thereby forming a predetermined turns ratio therebetween.

To this end, the primary power transmission pattern 131*a* and the secondary power transmission pattern 131*b* may be formed around the circumferences of the first and second boards 121 and 122, respectively, and may be formed in a spiral shape on the basis of the through holes H in order to obtain a desired turns ratio.

In the case that a high turns ratio is required, the primary power transmission pattern 131*a* and the secondary power transmission pattern 131*b* may be formed on the respective plurality of boards, and the primary power transmission pattern 131*a* or the secondary power transmission pattern 131*b* may be electrically connected with each other through the via holes h.

The plurality of boards may include a first cover board 123 to be stacked upon the first board 121 and a second cover board 124 to be stacked under the second board 122. As described above, the plurality of boards are stacked upon one another to thereby form a single transformer. At this time, in order to increase the insulating performance of the transformer, the boards may be coated with initiating resin to thereby form the resin part 140.

The resin part 140 may be formed on the board on which the power transmission pattern 131 is formed.

When the board, on which the resin part 140 is formed, is stacked, the insulating resin of the resin part 140 may be separated from the power transmission pattern 131 and be leaked through the via holes h. That is, the power transmission pattern 131 is formed by forming a copper plate on the board and etching the copper plate, leaving necessary portions thereof remaining. The insulating resin may be leaked through the via holes h along the remaining region of the board, on which the copper plate is not formed.

Therefore, the copper plate except for the power transmission pattern 131 is left on the remaining region of the board to form the dummy pattern 132, thereby reducing the remaining region where the insulating resin may leak by preventing the separation of the insulating resin.

FIGS. 3A through 3D are views illustrating carious embodiments of a pattern part formed on a board being used in a transformer according to an exemplary embodiment of the invention.

As described above, the dummy pattern 132 may be formed on the first board 121, on which the power transmission pattern 131 is formed, thereby preventing the separation of the insulating resin through via holes h.

Figure 3A:
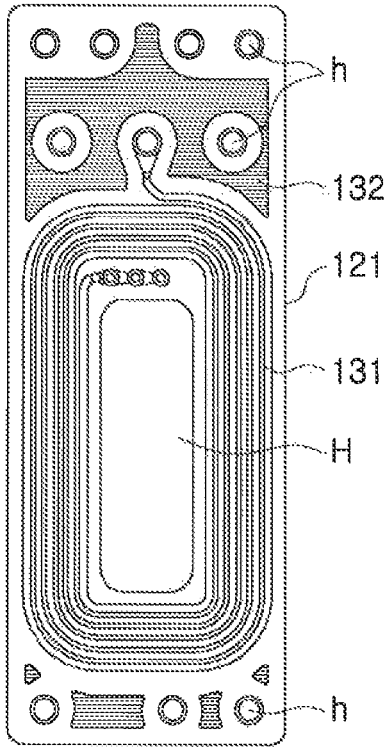
FIGS. 3A through 3D are configuration views illustrating various embodiments of a dummy pattern formed on a board that is used in a transformer according to an exemplary embodiment of the present invention.

As shown in FIG. 3A, when a plurality of via holes h are formed in the first board 121 and the power transmission pattern 131 is electrically connected to the via holes h, the dummy pattern 132 may be separated from the power transmission pattern 131 by a predetermined interval and be adjacent to the via holes h.

Figure 3B:
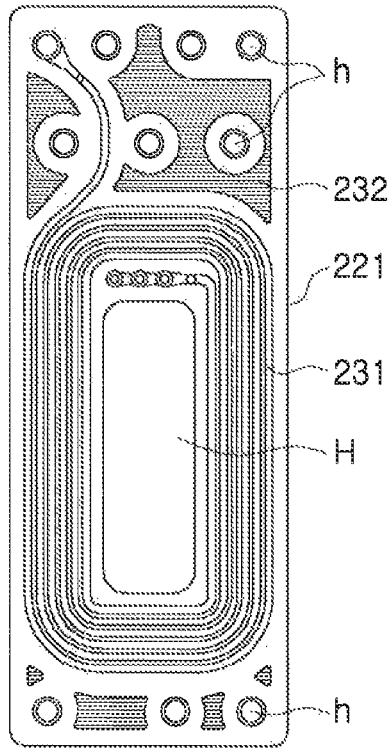

As shown in FIG. 3B, when a power transmission pattern 231 is electrically connected to a via hole, disposed on the outermost edge, among a plurality of via holes h in the board 221, a dummy pattern 232 may also be separated from the power transmission pattern 231 by a predetermined interval and be adjacent to the via holes h.

Figure 3C:
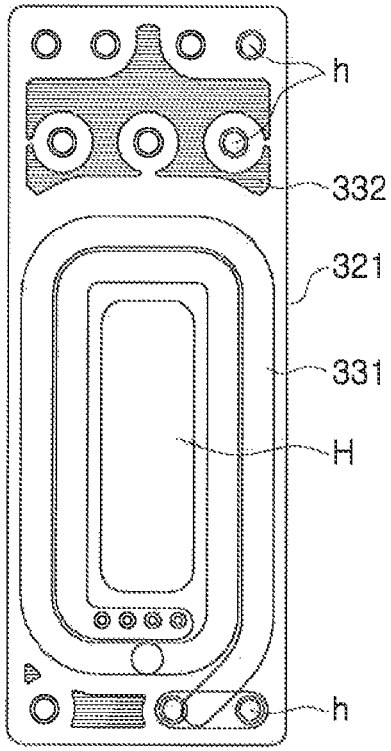

As shown in FIG. 3C, when a plurality of via holes h are formed in both sides of a board 321, if a power transmission pattern 331 is electrically connected to the via holes h formed in one side of the board 321, a dummy pattern 332 may be adjacent to the via holes h formed in the other side of the board 321.

Figure 3D:
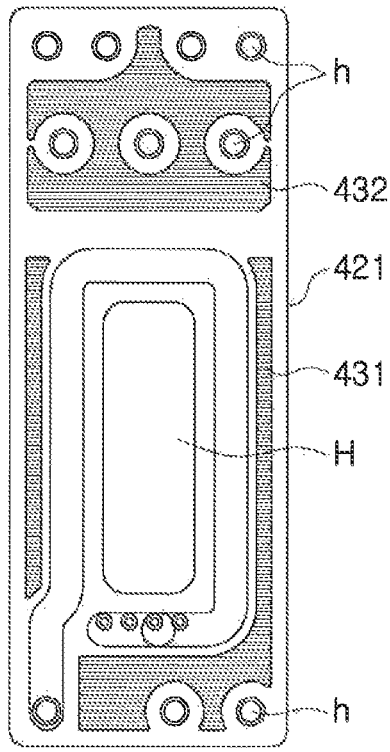

In the same manner, as shown in FIG. 3D, when a plurality of via holes h are formed in both sides of a board 421, if one side of a power transmission pattern 431 is electrically connected to the via holes h, a dummy pattern 432 may be separated from the power transmission pattern 431 by a predetermined distance and be adjacent to the via holes h formed in both sides of the board 421. The dummy pattern 432 may also be formed on a remaining region or the board, on which the power transmission pattern 431 is not formed, without being adjacent to the via holes h.

Figure 4:
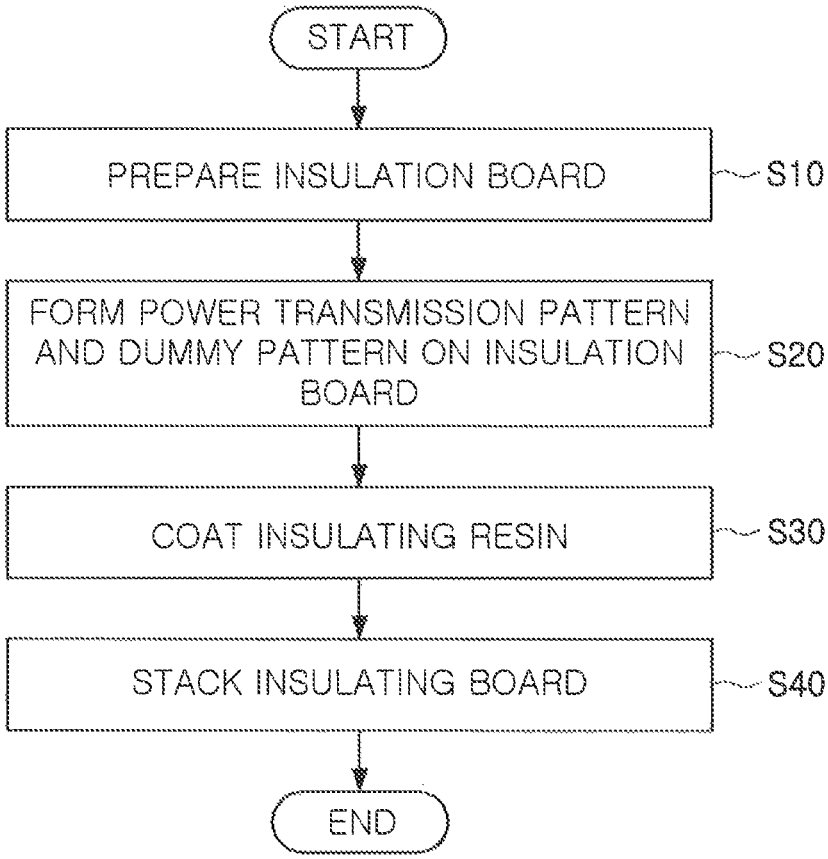
FIG. 4 is a flowchart illustrating a method of manufacturing a planar transformer according to an exemplary embodiment of the present invention.

FIG. 4 is a flowchart illustrating a method of manufacturing a planar transformer according to an exemplary embodiment of the invention.

According to a method of manufacturing a planar transformer, a plurality of boards are prepared in operation 310. As described above, the plurality of boards may include the first and second boards and the first and second cover boards as described above.

At least one of the plurality of boards or the first and second boards are coated with a copper plate, which is then removed by etching to thereby form the power transmission pattern and the dummy pattern in operation S20. The copper plate of the board that does not correspond to the power transmission pattern may not be etched to thereby form the dummy pattern.

The board on which the power transmission pattern and the dummy pattern are formed may be coated with the insulating resin in operation 330.

The plurality of boards are stacked upon one another, and the cores are then coupled thereto, thereby forming a single planar transformer in operation S40.

As described above, since dummy patterns are individually formed on boards, even when the boards are coated with insulating resin and are then stacked upon one another, the separation of the insulating resin is prevented to thereby improve the insulating performance of the transformer.

As set forth above, according to exemplary embodiments of the invention, the separation of resin to be coated when a transformer is manufactured is prevented by forming a dummy pattern on a board, thereby improving the insulating performance of the transformer.

While the present invention has been shown and described in connection with the exemplary embodiments, it will be apparent to those skilled in the art that modifications and variations can be made without departing from the spirit and scope of the invention as defined by the appended claims.

What is claimed is:

1. A planar transformer, comprising:

a core part having a pair of cores electromagnetically coupled to each other;

a board part having a plurality of boards disposed between the pair of cores and stacked upon one another;

a pattern part having a power transmission pattern provided on at least one board of the plurality of boards for transmitting power input thereto, and a dummy pattern provided on the same board having the power transmission pattern thereon, the dummy pattern separated from the power transmission pattern by a predetermined interval; and a resin part formed of an insulating resin coated on the at least one board of the plurality of boards, the at least one board having the pattern part thereon, wherein the pattern part is an etched copper plate formed on the at least one board and defining both the power transmission pattern and the dummy pattern, the at least one board includes via holes, and the dummy pattern is formed on the at least one board around the via holes to prevent a leakage of the insulating resin through the via holes.

2. The planar transformer of claim 1, wherein at least one of the via holes is electrically connected to the power transmission pattern.

3. The planar transformer of claim 2, wherein the dummy pattern is physically and electrically separated from the power transmission pattern and is adjacent to the via holes.

4. The planar transformer of claim 3, wherein the dummy pattern is provided on a remaining region of the at least one board, on which the power transmission pattern and the via holes are not provided.

5. The planar transformer of claim 1, wherein each of the plurality of boards has a through hole into which the core part is inserted.

6. The planar transformer of claim 5, wherein the power transmission pattern is provided along a circumference of the board and around the through hole of the at least one board.

7. The planar transformer of claim 6, wherein the power transmission pattern is formed in a spiral shape.

8. The planar transformer of claim 1, wherein the board part comprises a first board and a second board, the power transmission pattern comprises a primary power transmission pattern, provided on the first board, and a secondary power transmission pattern, provided on the second board, and the primary power transmission pattern and the secondary power transmission pattern form a predetermined turns ratio therebetween.

9. The planar transformer of claim 8, wherein the board part comprises:

a first cover board stacked upon the first board; and a second cover board stacked under the second board.

10. A method of manufacturing a planar transformer, the method comprising:

preparing a plurality of boards;

forming, on at least one board of the plurality of boards, a power transmission pattern for transmitting power applied thereto, and a dummy pattern separated from the power transmission pattern by a predetermined interval;

coating the at least one board with insulating resin; and stacking the plurality of boards one upon another, wherein the at least one board includes via holes, the power transmission pattern is formed by forming a copper plate on the at least one board and etching the copper plate, and the dummy pattern is formed, by etching the copper plate on the at least one board, around the via holes to prevent a leakage of the insulating resin through the via holes.

11. The method of claim 10, further comprising:

electrically connecting at least one of the via holes to the power transmission pattern.

12. The method of claim 11, wherein in the forming of the dummy pattern, the dummy pattern is physically and electrically separated from the power transmission pattern and is adjacent to the via holes.

13. The method of claim 12, wherein in the forming of the dummy pattern, the dummy pattern is formed on a remaining region of the at least one board, on which the power transmission pattern and the via holes are not formed.

14. The method of claim 10, further comprising:

forming a through hole in each of the plurality of boards, and inserting a core part having a pair of cores electromagnetically coupled to each other into the through hole.

15. The method of claim 14, wherein the forming of the power transmission pattern comprises forming the power transmission pattern along a circumference of the at least one board and around the through hole of the at least one board.

16. The method of claim 15, wherein the forming of the power transmission pattern comprises forming the power transmission pattern in a spiral shape.

17. The method of claim 10, wherein the preparing of the boards comprises preparing first and second boards, the forming of the power transmission pattern comprises forming a primary power transmission pattern on the first board and a secondary power transmission pattern on the second board, and the primary power transmission pattern and the secondary power transmission pattern form a predetermined turns ratio.

18. The method of claim 17, further comprising:

stacking a first cover board upon the first board; and stacking a second cover board under the second board.

19. A planar transformer, comprising:

a core part having a pair of cores electromagnetically coupled to each other;

a board part having a plurality of boards disposed between the pair of cores and stacked upon one another;

a pattern part having a power transmission pattern provided on at least one board of the plurality of boards for transmitting power input thereto, and a dummy pattern provided on the same board having the power transmission pattern thereon, the dummy pattern separated from the power transmission pattern by a predetermined interval; and an insulation part formed of an insulating material coated on the at least one board of the plurality of boards of the board part, the at least one board having the pattern part formed thereon, wherein the pattern part is an etched copper plate formed on the at least one board, and defining both the power transmission pattern and the dummy pattern, the at least one board includes via holes, and the dummy pattern is formed on the at least one board around the via holes to prevent a leakage of the insulating material through the via holes.

* * * * *